US005558391A

United States Patent [19]

Chavous

[11] Patent Number: 5,558,391

[45] Date of Patent: Sep. 24, 1996

[54] TRAY WITH REMOVABLE OBJECT SUPPORTING INSERT

[76] Inventor: Robert O. Chavous, 9 Orlando Dr., Chattanooga, Tenn. 37415

[21] Appl. No.: 348,534

[22] Filed: Dec. 1, 1994

[51] Int. Cl.[6] ..... A47B 83/02

[52] U.S. Cl. ..... 297/153; 297/149; 108/25; 108/26; 292/194; 292/252

[58] Field of Search ..... 297/153, 188.01, 297/149, 174, 148, 251, 252; 292/252, 194; 108/25, 26; 248/500, 510

[56] References Cited

U.S. PATENT DOCUMENTS

| | | | |
|---|---|---|---|
| 1,003,245 | 9/1911 | Emmons | 297/153 |
| 1,112,738 | 10/1914 | Voigt | 292/194 X |
| 1,881,416 | 10/1932 | Hault | 108/25 X |
| 2,683,639 | 7/1954 | Brenny | 108/26 X |
| 2,767,774 | 10/1956 | Derby | 297/149 |
| 2,826,469 | 3/1958 | Grant | 108/26 X |
| 2,832,623 | 4/1958 | Coleman | 292/252 X |
| 3,148,636 | 9/1964 | Bloomquist et al. | 108/26 |
| 3,249,070 | 5/1966 | Day et al. | 108/26 |
| 3,511,531 | 5/1970 | Benoit et al. | 297/153 |
| 3,635,522 | 1/1972 | Kerwit | 297/153 |
| 3,688,707 | 9/1972 | White | 108/25 X |
| 3,764,172 | 10/1973 | Standke | 292/252 X |
| 3,899,982 | 8/1975 | Fetzek | 108/25 |
| 4,105,247 | 8/1978 | Saint | 297/149 |
| 4,155,126 | 5/1979 | Classen | 297/153 X |
| 4,241,668 | 12/1980 | Carroll | 108/26 |
| 4,373,756 | 2/1983 | Purdy et al. | 297/153 |
| 4,512,597 | 4/1985 | Nabb et al. | 292/252 X |
| 4,662,676 | 5/1987 | Havelock | 108/26 X |
| 4,940,003 | 7/1990 | Mayhew et al. | 108/25 X |
| 5,050,929 | 9/1991 | Gueringer et al. | 297/149 X |
| 5,087,097 | 2/1992 | Hehn | 297/153 |
| 5,092,652 | 3/1992 | Macaluso | 108/26 X |
| 5,207,544 | 5/1993 | Yamamoto et al. | 292/252 X |
| 5,310,244 | 5/1994 | Borgardt | 297/153 |
| 5,327,838 | 7/1994 | Beltman | 108/26 X |

FOREIGN PATENT DOCUMENTS

| | | | |
|---|---|---|---|
| 797109 | 10/1968 | Canada | 292/194 |
| 661625 | 6/1938 | Germany | 108/25 |
| 815226 | 10/1951 | Germany | 297/188.01 |
| 841223 | 4/1952 | Germany | 292/194 |
| 176989 | 3/1922 | United Kingdom | 297/153 X |
| 196741 | 5/1923 | United Kingdom | 108/25 |
| 721127 | 12/1954 | United Kingdom | 297/149 |
| 2179547 | 3/1987 | United Kingdom | 297/149 |

*Primary Examiner*—Peter M. Cuomo
*Assistant Examiner*—Rodney B. White
*Attorney, Agent, or Firm*—Pitts & Brittian, P.C.

[57] ABSTRACT

A tray (10) for removably supporting useful objects such that the objects are stationary in order to facilitate their use by disabled persons. The tray (10) includes a tray body (12) defining an upper work surface (14), and defining at least one opening (16) therein. The tray (10) also includes at least one object supporting insert (18) for being removably received and supported in the opening (16) in the tray body (12). The object supporting insert (18) defines an upper surface (30) on which the useful object is secured, such that the useful object is maintained in a stationary position to facilitate its use as the object supporting insert (18) is positioned in the opening (16) in the tray body (12), yet can be removed from the tray body (12) through the removal of the object supporting insert (18).

24 Claims, 7 Drawing Sheets

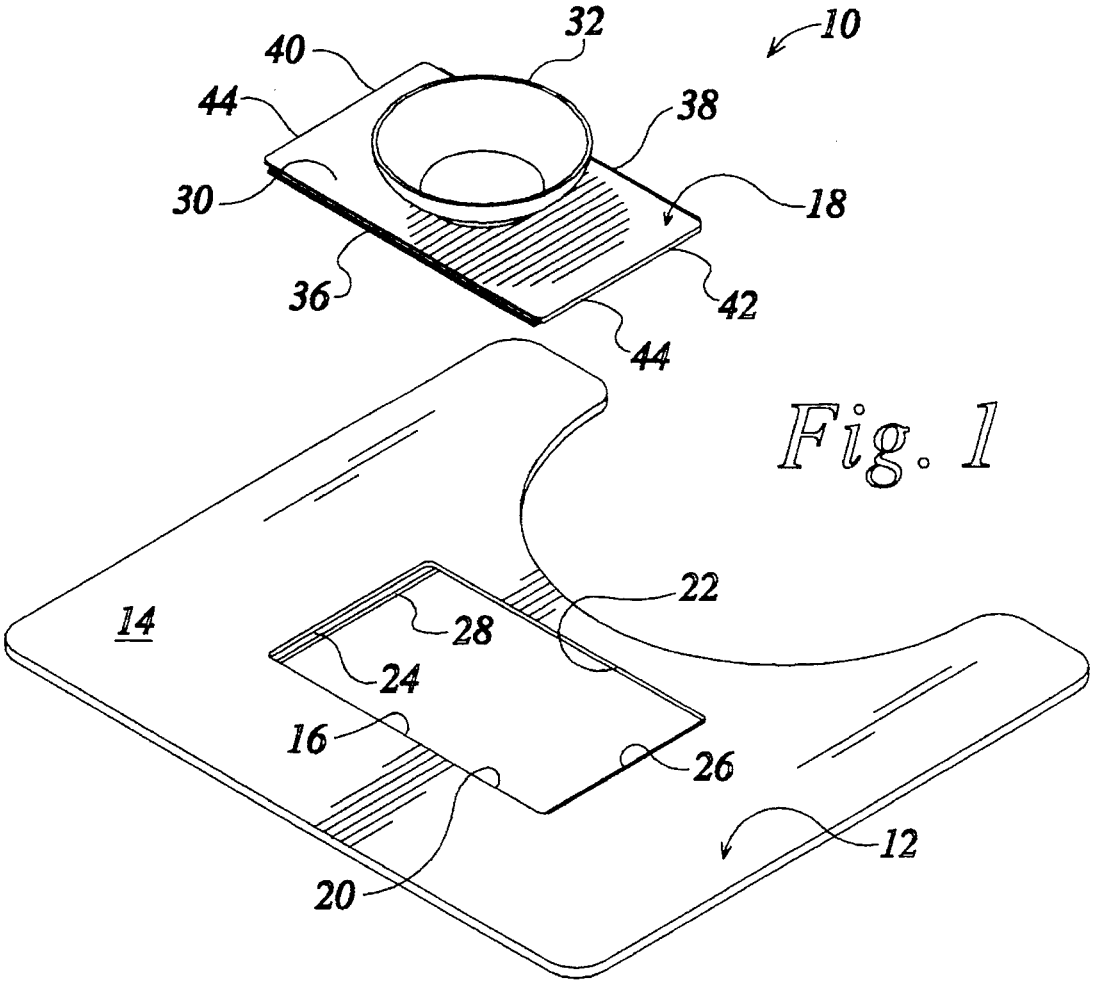
Fig. 1
Fig. 2
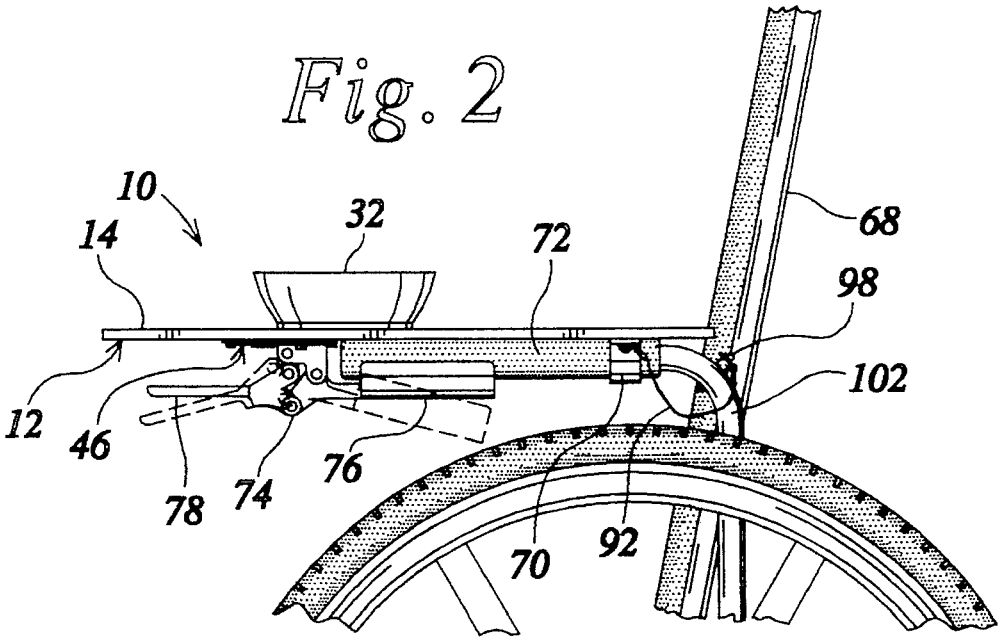

Fig. 10
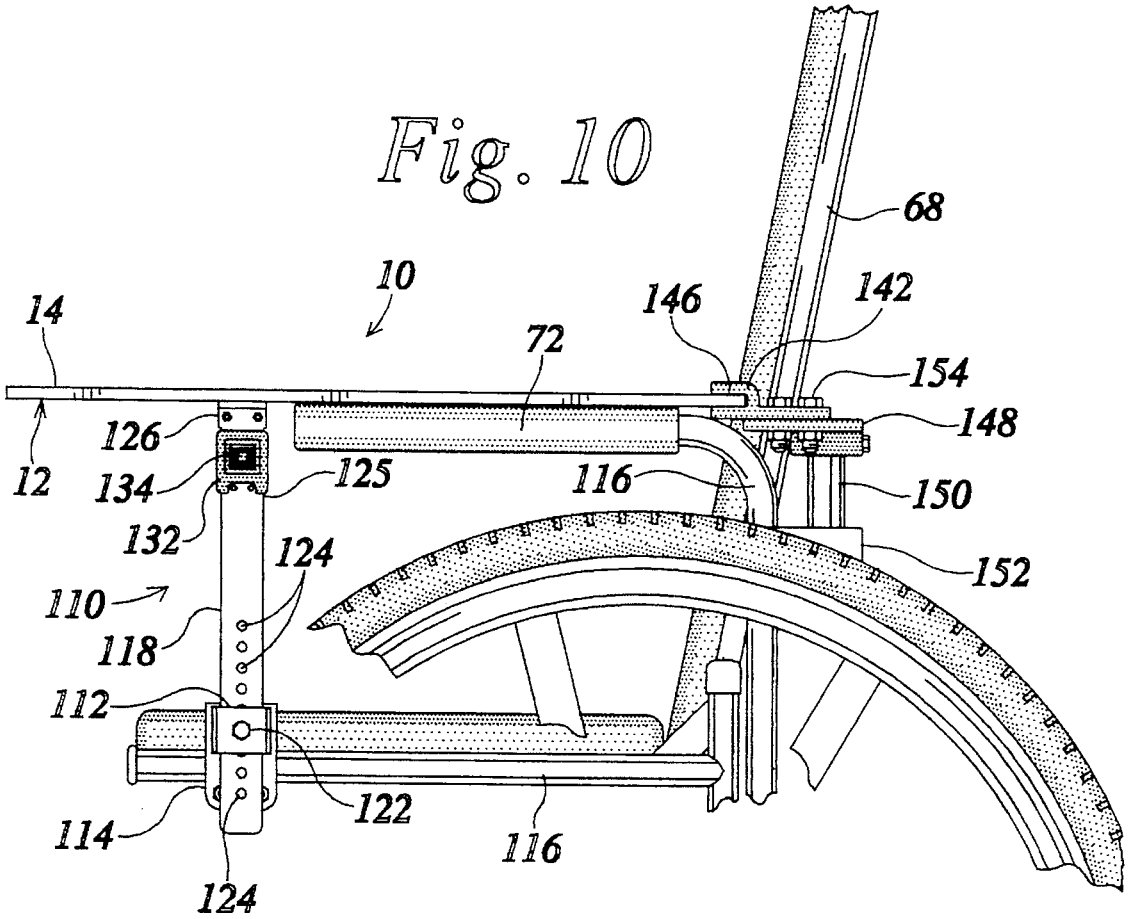
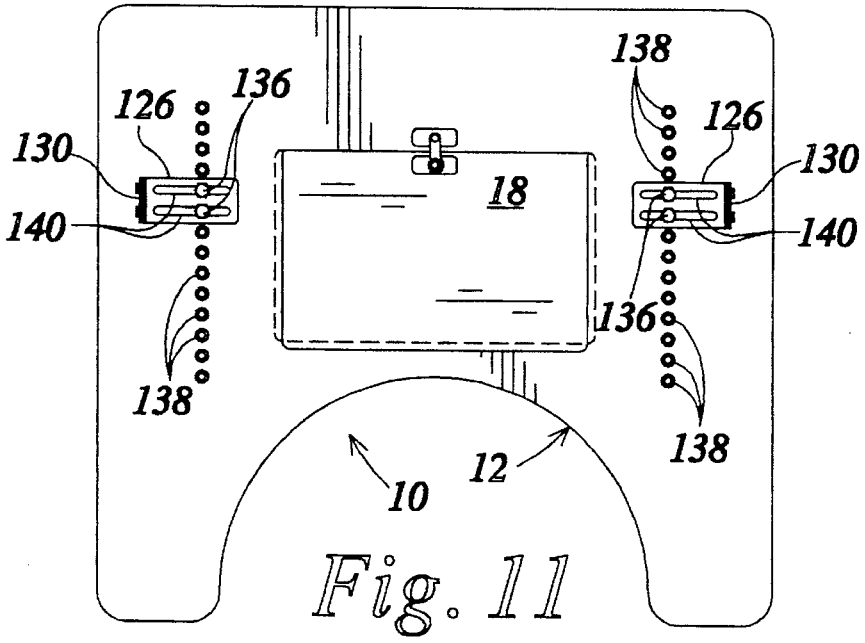
Fig. 11

TRAY WITH REMOVABLE OBJECT SUPPORTING INSERT

TECHNICAL FIELD

This invention relates to a tray with a removable, and/or interchangeable, object supporting inserts for supporting useful objects and devices in a fixed position to facilitate use of such objects and devices by disabled persons. In this particular invention the tray includes a tray body defining an opening for removably mounting an object supporting insert.

BACKGROUND ART

For persons with certain physical disabilities it can be difficult to manipulate objects or use devices on a work surface without those objects or devices being secured in a stationary position. For example, objects which are not fixed in position may move upon the work surface making them difficult to use, or may fall from the work surface causing damage to the objects. Similar problems can arise where mental capacity is impaired. In this regard, it is often desirable to fix the position of objects such that they cannot be knocked or thrown from a work surface. Of course, objects can be bolted to a work surface or bonded to the work surface with adhesives, but this limits use of the work surface to a specific task. For example, a computer terminal can be secured with bolts to a table to facilitate its use by a disabled person, but in doing so the table becomes dedicated to use in conjunction with the computer.

Therefore, it is an object of the present invention to provide a tray with interchangeable object supporting inserts which support various useful objects and devices in a stationary position to facilitate the use of such objects and devices by persons with physical or mental disabilities.

It is another object of the present invention to provide a tray with interchangeable object supporting inserts for supporting useful objects and devices in which the inserts can be easily interchanged.

Yet another object of the present invention is to provide a tray with interchangeable object supporting inserts for supporting useful objects and devices which is adaptable for mounting on a wheel chair or standing chair, and which securely engages the chair, yet which can be quickly removed if necessary.

Still another object of the present invention is to provide a tray with interchangeable object supporting inserts for supporting useful objects and devices which can be modified for use as a standing table, or for use as the work surface for a work station or desk.

A further object of the present invention is to provide a tray with interchangeable object supporting inserts which is inexpensive to manufacture, and easy to use.

DISCLOSURE OF THE INVENTION

Other objects and advantages will be accomplished by the present invention which provides a tray for removably supporting useful object such that the objects are stationary to facilitate their use by disabled persons. The tray comprises a tray body defining an upper work surface, and defining at least one opening therein. The tray also includes at least one object supporting insert for being removably received and supported in the opening in the tray body. The object supporting insert defines an upper surface on which the useful object is secured. As a result, the useful object is maintained in a stationary position to facilitate its use as the object supporting insert is positioned in the opening in the tray body, yet can be removed from the tray body through the removal of the insert. Accordingly, inserts supporting various useful objects can be interchangeably positioned in the opening of the tray body with out fear that the useful objects will fall from the tray during use, or be removed from the tray by the user.

BRIEF DESCRIPTION OF THE DRAWINGS

The above mentioned features of the invention will be more clearly understood from the following detailed description of the invention read together with the drawings in which:

FIG. 1 illustrates a perspective view of a tray with removable object supporting insert of the present invention.

FIG. 2 illustrates a side elevation view of a tray of the present invention mounted on a wheel chair.

FIG 10 illustrates a partial side elevation view, partially in section, of alternate embodiment of a tray of the present invention.

FIG. 11 illustrates a bottom view of an alternate embodiment of a tray of the present invention.

BEST MODE FOR CARRYING OUT THE INVENTION

Figure 9:
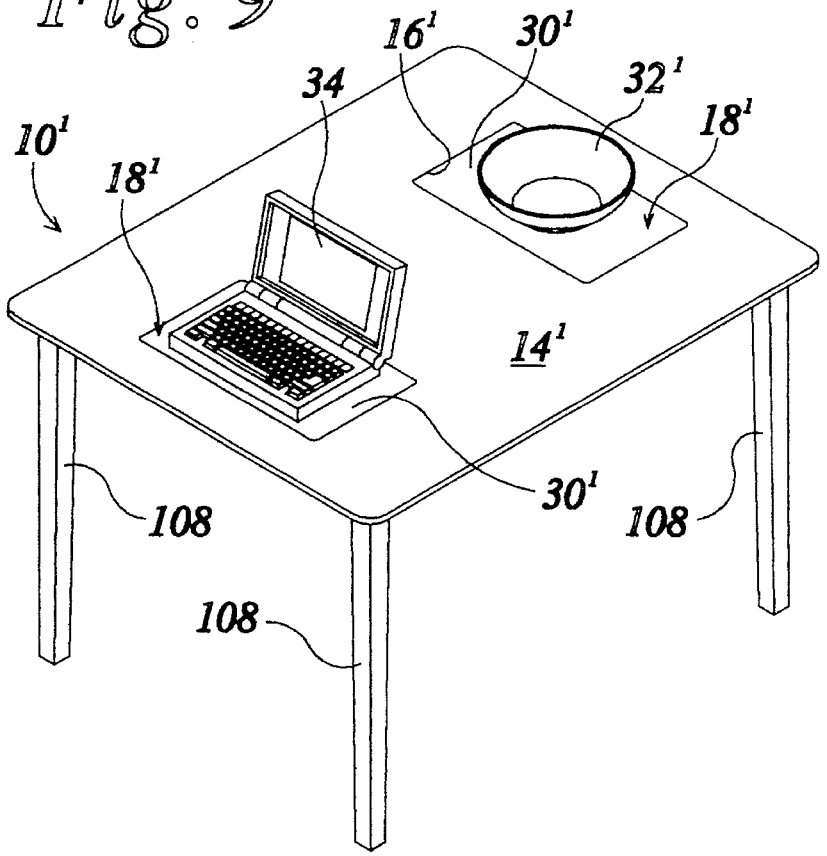
FIG. 9 illustrates a perspective view of an alternate embodiment of the tray of the present invention.

A tray with a removable object supporting insert incorporating various features of the present invention is illustrated generally at 10 in the Figures. As noted above, the tray 10 is designed to support various useful objects such that the objects are in a stationary position to facilitate their use by disabled persons. Thus, whereas the tray is illustrated in FIGS. 1 and 2 as supporting a bowl, and in FIG. 9 as supporting a computer, it will be understood that various objects can be removably supported on the tray 10.

Figure 4:
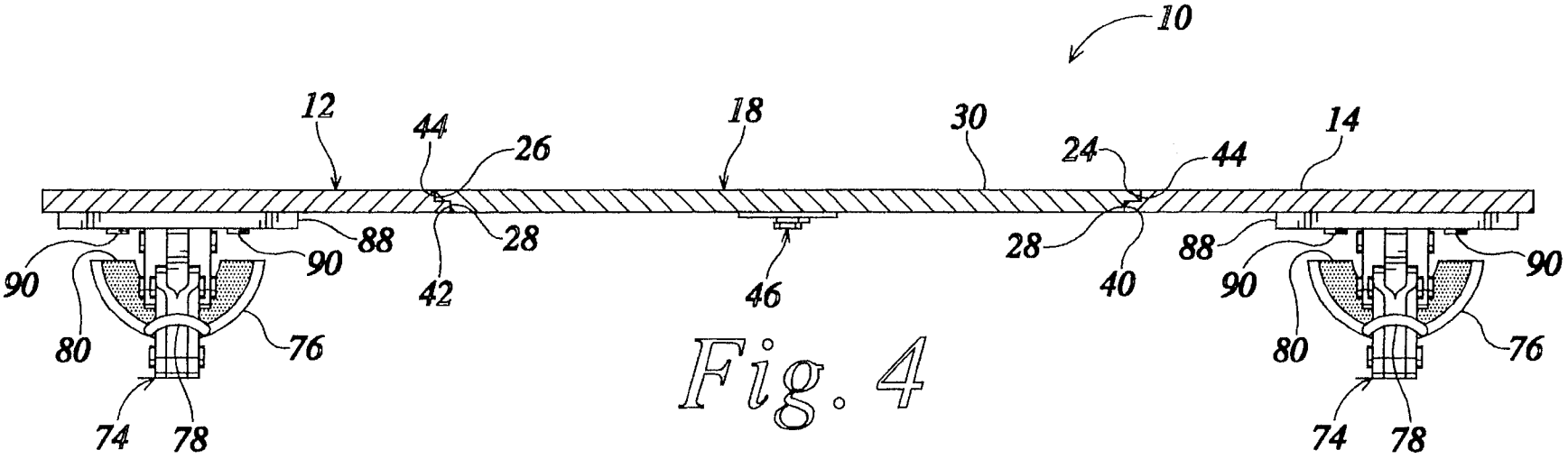
FIG. 4 illustrates a rear elevation view, in section at 4—4 in FIG. 6, of a tray of the present invention.

The tray 10 includes a tray body 12, defining an upper work surface 14. Preferably the tray body 12 is fabricated from a hard durable plastic substance, such as Lexan®. However, other durable fabricating material can be used. The tray body 12 defines at least one opening 16 for removably receiving an object supporting insert 18. In the illustrated preferred embodiment the opening 16 defines a rectilinear perimeter, including first and second oppositely disposed edges 20 and 22, respectively, and third and forth oppositely disposed edges 24 and 26, respectively. As best illustrated in FIG. 4, the oppositely disposed edges 24 and 26 define ledges 28 which extend along the lengths of the edges 24 and 26, or substantial portions thereof. As will be discussed further below, the ledges 28 serve to support the object supporting insert 18 when such insert is positioned within the opening 16.

The object supporting insert 18 is closely, and removably, received in the opening 16, and is preferably fabricated of a strong durable plastic material, such as Lexan®, but other strong durable materials may be suitable. The insert 18 defines an upper surface 30 on which various objects, such as the illustrated bowl 32 (see FIG. 1 and 2) or the computer 34 (see FIG. 9), are fixedly secured. In this regard, the invention contemplates the interchangeable use of multiple inserts 18 having various objects fixedly mounted thereon.

In the preferred embodiment, the insert 18 defines a rectilinear configuration having first and second opposite edge portions 36 and 38, respectively, and third and fourth opposite edge portions 40 and 42, respectively. The third and forth opposite edge portions 40 and 42 define supporting lip portions 44 (See FIG. 4) which extend along the lengths of the edge portions 40 and 42, or substantial portions thereof. As best illustrated in FIG. 4, the supporting lip portions 44 of the insert 18 engage, and support the insert 18 upon, the ledges 28 of the tray body 12.

Figure 5:
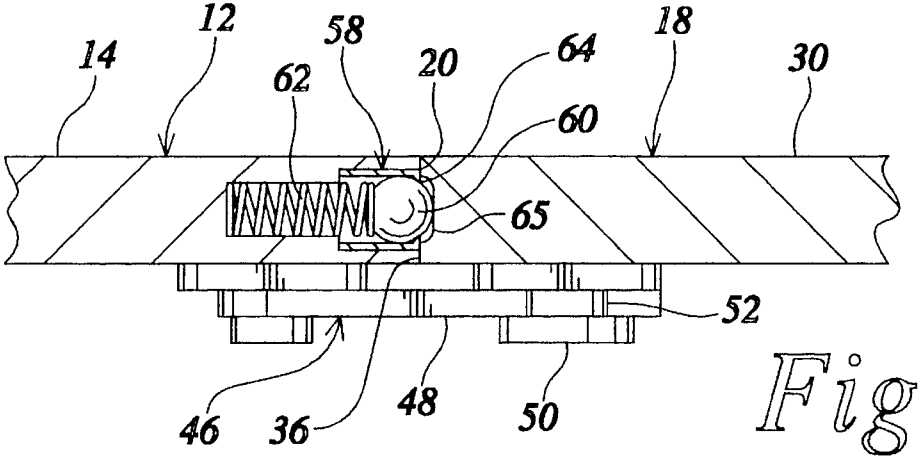
FIG. 5 illustrates a partial side elevation view, in section, of a tray of the present invention.
Figure 6:
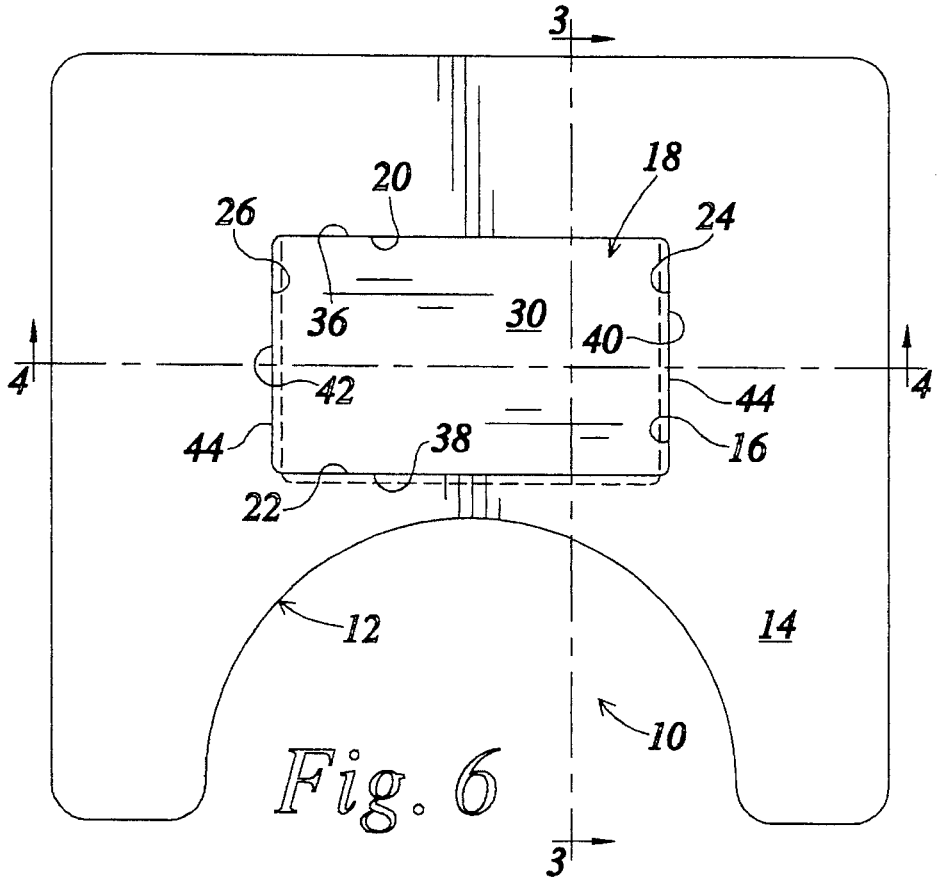
FIG. 6 illustrates a top plan view of a tray of the present invention.
Figure 7:
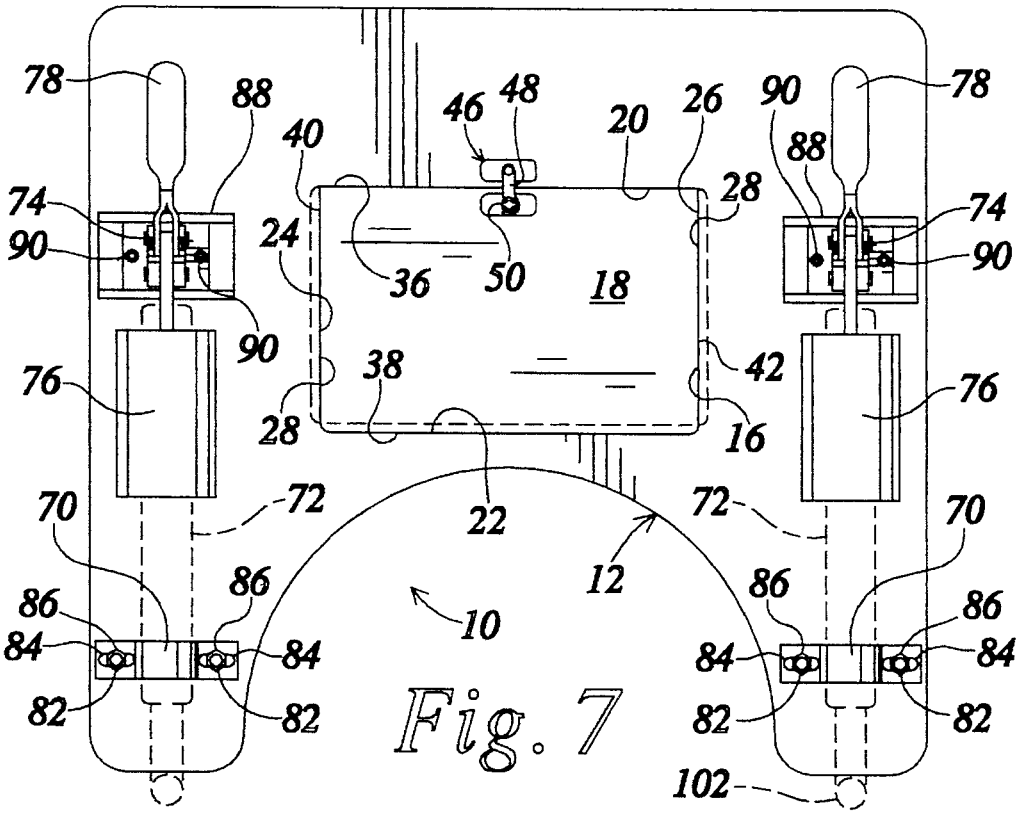
FIG. 7 illustrates a bottom plan view of a tray of the present invention.

In order to releasably lock the object supporting insert 18 in position in the opening 16, the tray 10 is provided with a locking mechanism which in the illustrated embodiment includes a latch 46. As best illustrated in FIGS. 5 and 7, the latch 46 includes a latch bar defining a hook member 48 pivotally mounted on the under surface of the tray body 12 proximate the opening 16, and a keeper 50 having a pin 52 for releasably receiving the hook member 48. In one preferred embodiment the latch 46 is fabricated of stainless steel to prevent rusting and corrosion, but other strong, durable materials can be used. For example, it is contemplated that it may be desirable to fabricate at least the keeper 50 from a microwaveable material, such as a ceramic. This construction allows the insert 18 to be used in a microwave oven, as for example, in a situation where the insert supports a bowl or dish of food which requires heating before it is served.

The locking mechanism can also include one or more ball latches 58. As best illustrated in FIG. 5, each of the ball latches 58 includes a latch ball 60 which is mounted in a cavity defined in the first edge 20 of the tray body 12. A spring member 62 is provided for biasing the latch ball 60 toward an opening 64 in the edge 20 which permits a portion of the ball 60 to extend beyond the edge 20. A recess 65 is provided in the first edge portion 36 of the insert 18 which registers with the opening 64, and which releasably receives the ball 60 as the insert 18 is positioned in the opening 16, thereby releasably maintaining the position of the insert 18 in the opening 16.

To further facilitate the proper positioning of the insert 18 in the opening 16, in the preferred embodiment a recess 54 is defined in the lower surface of the tray body 12 along the second edge 22 at the opening 16. (See FIG. 3) Also, the insert 18 is provided with a further lip portion 56 disposed along at least a portion of the second edge portion 38 of the insert 18. As best illustrated in FIG. 3, the further lip 56 is received in the recess 54, thereby prohibiting upward movement of the insert 18 proximate the second edge portion 38 as the insert is positioned in the opening 16.

Figure 3:
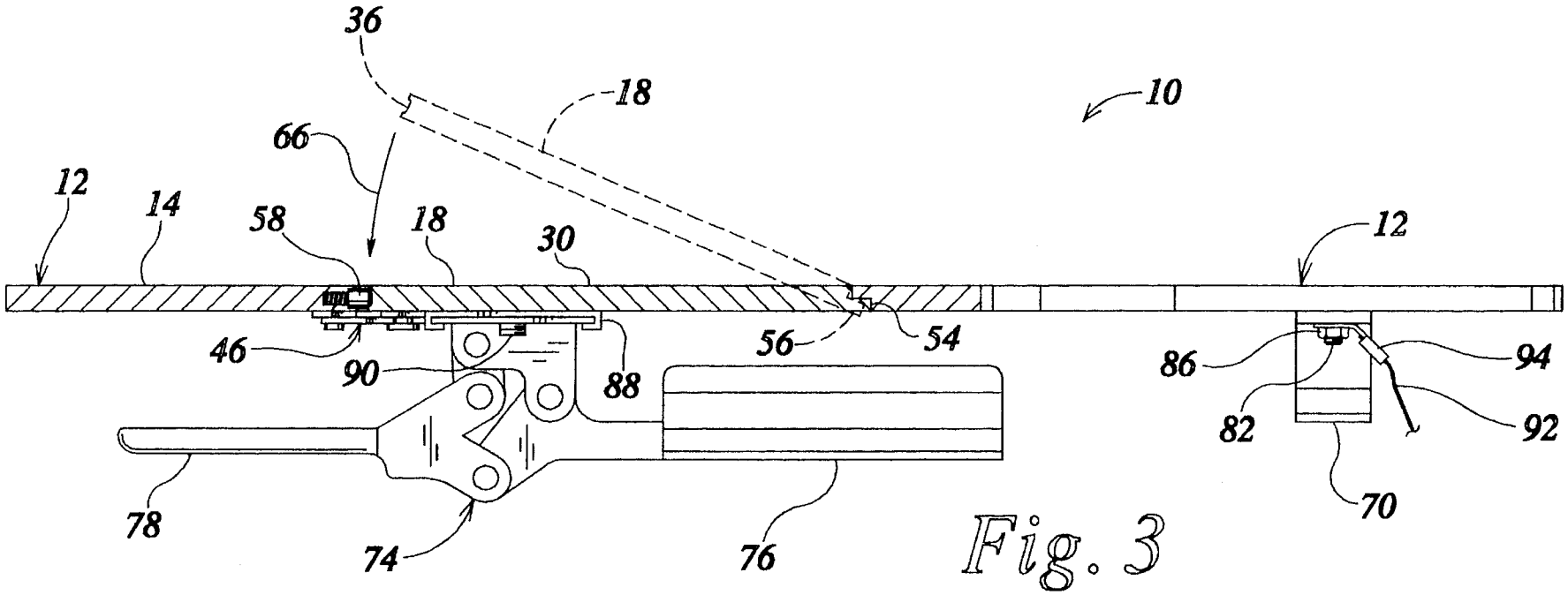
FIG. 3 illustrates a side elevation view, in section at 3—3 in FIG. 6, of a tray of the present invention.

Thus, as illustrated in FIG. 3 it will be understood that in order to secure an insert 18 in the opening 16, the further lip 56 of the insert is positioned for reception into the recess 54. The first edge portion 36 of the insert 18 is then pivoted downwardly as illustrated by the arrow 66 and positioned in the opening 16, whereupon the ball latches 58 releasably secure the relative positions of the first edge 20 of the tray body 12 and the first edge portion 36 of the insert 18. If desired, the insert 18 can be more securely locked in place by securing the latch 46.

Figure 8:
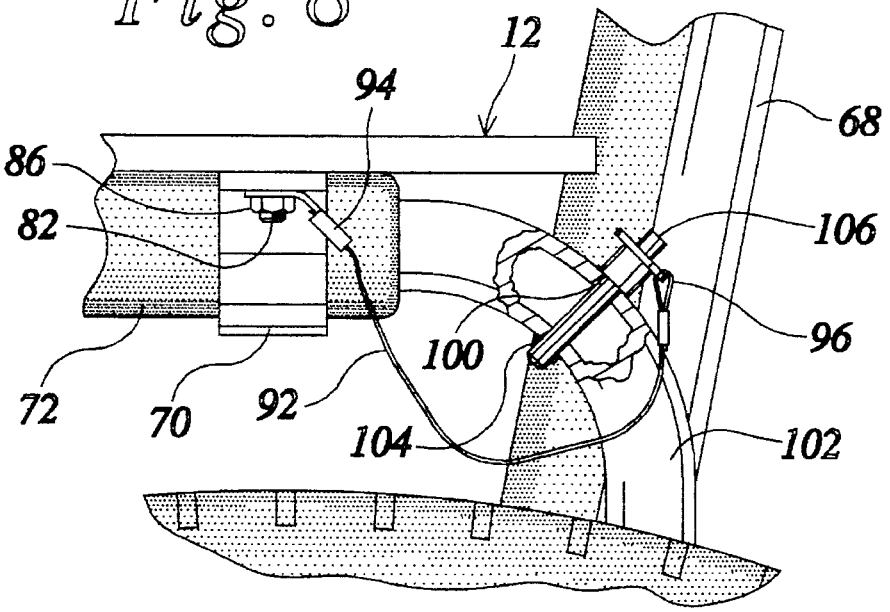
FIG. 8 illustrates a partial side elevation view, partially in section, of a tray of the present invention.

Whereas it is contemplated that the tray 10 can be supported on various structures, in FIGS. 2 and 8 the tray 10 is illustrated as being mounted on a wheel chair 68. In the preferred illustrated embodiment of FIGS. 1–8, the tray 10 is provided with rearward clamp members 70 which slidably receive the arms 72 of the wheel chair 68. Further, forward clamp members 74 are provided for releasably engaging the distal end portions of the arms 72. In this regard, the forward clamp members 74 include pivotally mounted engaging members 76 which are selectively pivoted into, and out of, engagement with the arms 72 by pivoting an operatively associated actuator handle 78. As illustrated in FIG. 4, in the preferred embodiment the engaging members 76 are provided with cushioned linings 80 fabricated of foam rubber or other soft, resilient material, to avoid damage to the arms 72.

It will also be noted that the distance between the arms of conventional wheel chairs can vary. Therefore, in the preferred embodiment, the lateral position of the rearward clamp members 70 and forward clamp members 74 is adjustable to accommodate varying arm spacings. For example, in the illustrated embodiment of FIG. 7, bolts 82 extending from the lower surface of the tray body 12 are received though laterally aligned slots 84 provided in the clamp members 70. As a result, by disposing the bolts 82 in the desired position along the slots 84 the lateral position of the clamp members 70 can be selected, and the nuts 86 can be used to threadably fix the position of the clamp members 70.

Further, the clamp members 74 are slidably mounted in bracket members 88 such that they are laterally movable, and the set screws 90 are provided for threadably fixing the position of the clamp members 74. Of course, other means can be used to provide for lateral adjustment of the clamp members 70 and 74 if desired.

Since it is contemplated that the tray 10 will be used to facilitate the use of various objects mounted on the insert 18 by persons who are physically or mentally impaired, it is important to protect against inadvertent detachment of the tray body 12 from the arms 72 of the wheel chair 68. Therefore, the tray 10 can be provided with a safety cable 92 which is secured at a first end 94 to the tray body 12 and at a second end 96 to the wheel chair 68, such that the arms 72 are prohibited from being removed from the clamp members 70. (See FIGS. 2 and 8) More specifically, in the preferred embodiment the first end 94 of the Cable 92 is secured to one of the clamp members 70, and the second end 96 of the safety cable 92 carries a locking pin 90 which is slidably received through a pair of registering openings 100 provided in the arm support 102 of the wheel chair 68. In the illustrated embodiment the pin 98 incorporates a ball latch mechanism 104 which releasably locks the pin 98 in the openings 100, the ball latch mechanism being selectively released by actuation of a button 106. Of course, it is contemplated that other locking mechanisms can be used for releasably locking the pin 98 in place. Further, whereas only one cable 92 is shown in the Figures, it is contemplated that safety cables 92 operatively associated with both clamp members 70 can be provided such that the tray 10 is secured by safety cable to both arm supports 102.

In FIGS. 10–13, an alternate clamp mechanism for mounting the tray 10 on a wheel chair is illustrated. This clamp mechanism includes a pair of forward clamp assemblies 110 and a pair of rear guide assemblies 112, with one clamp assembly 110 and one guide assembly 112 being secured to the frame 116 of the wheel chair 68 on each side of the chair 68. Each of the forward clamp assemblies 110 includes a clamp member 114 which is releasably secured to the frame 116 of the wheel chair 68, and which releasably receives an elongated tray support 118. More specifically, in the preferred embodiment the clamp member 114 defines a slot 120 through which the tray support 118 is slidably received, and the clamp member 114 is provided with a set screw 122 which is selectively received in one of a plurality of selectively spaced receptors 124 provided along the tray support 118. Accordingly, the position of the tray support 118 is vertically adjustable such that the height of the tray body 12 can be selectively fixed.

Whereas the upper end 125 of the tray supports 118 can be secured directly to the tray 10, in the preferred embodiment, each of the clamp assemblies 110 also includes a securing bracket 126 which releasably engages the traybody 12 and the upper end 125 of the tray support 118. In the preferred illustrated embodiment, seat belt-type locking mechanisms 128 are provided for releasably securing the tray 10 on the tray supports 118. In this regard, each of the securing brackets 126 includes a male lock component 130 which is releasably received in a female lock component 132 carried at the upper end 125 of each tray support 118, with each of the female lock components being provided with actuator buttons 134 for selectively effecting the release of the male lock component 130.

In the preferred embodiment the securing brackets 126 are secured to the tray body 12 with threaded fasteners 136 which are received through slots 140 provided in the securing brackets 126. The slots 140, allow the distance between the male lock components 130 to be adjusted such that the clamp assemblies 110 can accommodate wheel chairs having different seat widths. Also, in order to allow the clamp assemblies 110 to accommodate different wheel chairs, and to allow adjustable positioning of the tray body 12 relative to the chair, the tray body 12 is provided with a plurality of threaded receptors 138 disposed in rows on either side of the opening 16 (See FIG. 11) for receiving the threaded fasteners 136. Accordingly, the brackets 126 can be selectively positioned as desired by selecting the threaded receptors 136 to be used.

Figure 13:
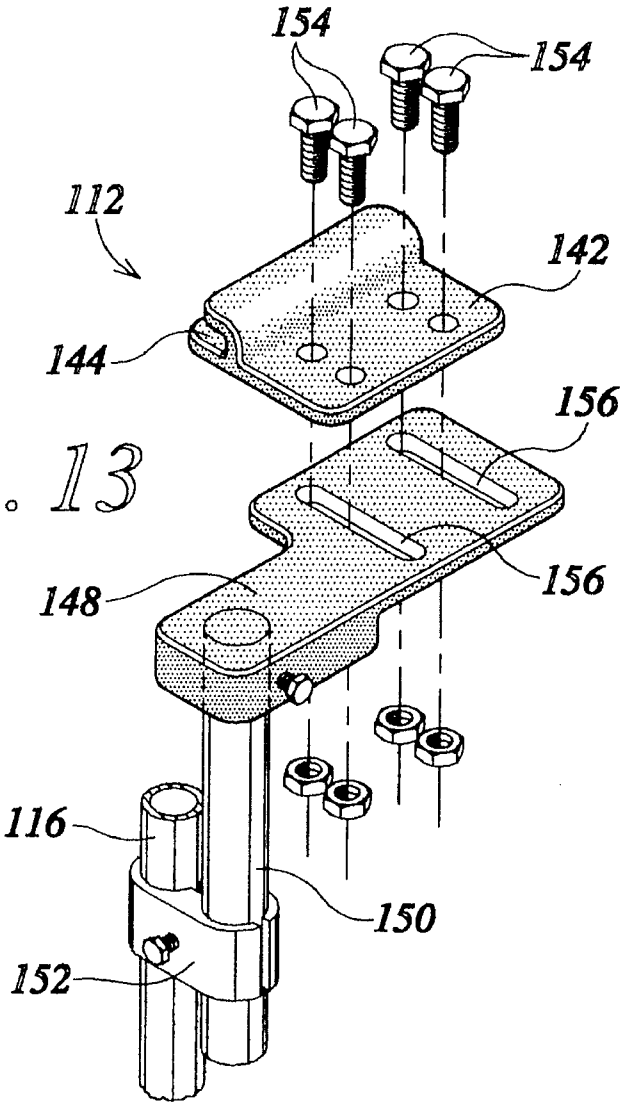
FIG. 13 illustrates a perspective view of a guide assembly of a tray of the present invention.
Figure 12:
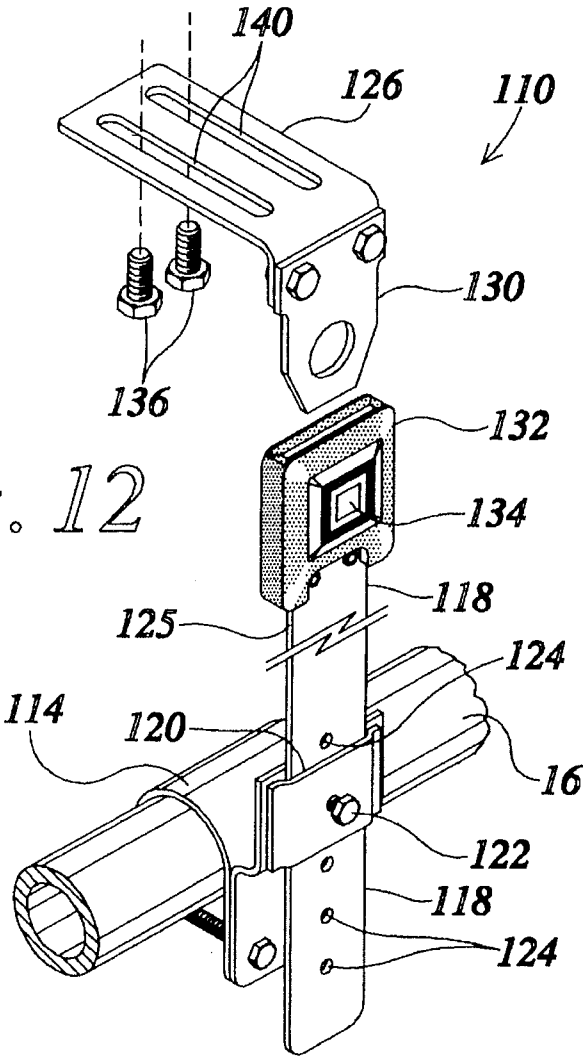
FIG. 12 illustrates a perspective view of a clamp assembly of a tray of the present invention.

As illustrated in FIGS. 10 and 13, in the preferred embodiment each of the guide assemblies 112 includes a guide member 142 which is releasably secured to the frame 116 of the wheel chair 68, and defines a slot 144 which releasably receives the rearward edge 146 of the tray body 12 in order to support the tray body 12 in a desired position. More specifically, in the preferred embodiment each guide assembly includes a base plate 148 on which the guide member 142 is releasably supported, with the base plate 148 having a downwardly disposed mounting rod 150 to facilitate the mounting of the base plate 148 on the frame 116 of the chair. As illustrated in FIG. 13, a clamp 152 is provided for securing the mounting rod 150 to the frame 116. It will be recognized that the height of the base plate 148, and, thus, the height of the guide member 142, can be adjusted by selecting the point along the mounting rod 150 at which the clamp 152 releasably engages the rod 150. Further, it will be noted that the guide member 142 is secured to the base plate 148 with threaded fasteners 154 which are received through slots 156 provided in the base plate 148. Accordingly, the guide member 142 can be selectively positioned between forwardly and rearwardly disposed positions to allow the position of the tray body to be adjusted and in order to accommodate wheel chairs having different configurations.

Whereas in the illustrated embodiments of FIGS. 1–8 and 10–13 the tray 10 is configured to be mounted on a wheel chair, it is contemplated that the tray of the present invention could be supported on various structures. For example, an alternated embodiment of the tray is illustrated at 10' in FIG. 9. Features of the tray 10' which are common to the tray 10 described above are referenced in FIG. 9 with common prime numerals. As illustrated, the tray 10' is supported by leg members 108. Further, the tray 10' is provided with two openings 16' in order to accommodate two inserts 18'. Of course, other numbers of openings 16' can be provided if desired.

In light of the above it will be recognized that the present invention provides a tray with interchangeable object supporting inserts having great advantages over the prior art. The interchangeable object supporting inserts 18 support various useful objects and devices in a stationary position to facilitate the use of such objects and devices by persons with physical or mental disabilities. Accordingly, the tray 10 is not dedicated to a particular function, and by substituting inserts 18 with various objects, a disabled person can be presented with a wide variety of activities without changing, or being moved to different, locations. The tray 10 is adaptable for mounting on a wheel chair or standing chair, and while it securely engages the chair to facilitate safety, it can be quickly removed if necessary. Further, the tray 10 can be modified for use as a standing table, or can be used as the work surface for a work station or desk. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A tray for removably supporting a useful object, said tray comprising:

a tray body defining an upper work surface and a lower surface, and defining at least one opening;

at least one object supporting insert for being removably received and supported in said opening of said tray body, said object supporting insert defining an upper surface on which the useful object is secured, whereby the useful object is maintained in a stationary position to facilitate its use as said object supporting insert is positioned in said opening of said tray body, and whereby the useful object is removable from said tray body through the removal of said object supporting insert; and a locking mechanism for releasably locking said object supporting insert in said opening of said tray body, said locking mechanism including a latch assembly having a pivoting bar which selectively engages a keeper, whereby said bar extends between said tray body and said object supporting insert as said pivoting bar engages said keeper.

2. The tray of claim 1 wherein said bar defines a hook member and said keeper defines a pin for releasably receiving said hook member.

3. The tray of claim 1 wherein said tray is provided with a plurality of clamp members for releasably engaging a wheel chair, whereby said tray is supported by said wheel chair and the useful object secured to said object supporting insert is disposed for use by an occupant of such wheel chair.

4. The tray of claim 3 wherein said tray further comprises at least one safety cable having a first end secured to said tray body and having a second end for securing to the wheel chair to prohibit said tray body from becoming detached from the wheel chair.

5. The tray of claim 4 wherein said first end of said safety cable is secured to at least one of said clamp members of said tray and said second end of said safety cable is provided with a latch pin for being releasably received in an opening provided in a structure of the wheel chair.

6. The tray of claim 1 wherein said tray is provided with a pair of clamp assemblies for releasably engaging a wheel chair, whereby said tray is supported by said wheel chair and the useful object secured to said object supporting insert is disposed for use by an occupant of such wheel chair, said each said clamp assembly including a tray support for being releasably secured to the frame of the wheel chair and including a securing bracket for being mounted on said tray body and for releasably engaging said tray support.

7. The tray of claim 6 wherein each said clamp assembly includes a seat belt-type locking mechanism for releasably securing said securing bracket to said tray support.

8. The tray of claim 7 wherein said tray includes a pair of guide assemblies for supporting said tray body on the wheel chair, each said guide assembly including a guide member for being releasably mounted on the frame of the wheel chair and defining a slot for releasably receiving an edge of said tray body.

9. The tray of claim 8 wherein each said guide assembly includes a base plate on which said guide member is supported, said base plate carrying a downwardly disposed mounting rod, each said guide assembly also including a clamp for releasably engaging the frame of the wheel chair and for releasably engaging said mounting rod at selected positions along said mounting rod to effect the mounting of said guide assembly on the frame of the wheel chair.

10. A tray for removably supporting a useful object, said tray comprising:

a tray body defining an upper work surface and a lower surface, and defining at least one opening, said opening defining a rectilinear perimeter including first and second oppositely disposed edges, and third and fourth oppositely disposed edges, each said third and fourth oppositely disposed edge defining a ledge portion;

at least one object supporting insert for being removably received and supported in said opening of said tray body, said object supporting insert defining an upper surface on which the useful object is secured, whereby the useful object is maintained in a stationary position to facilitate its use as said object supporting insert is positioned in said opening of said tray body, and whereby the useful object is removable from said tray body through the removal of said object supporting insert, said object supporting insert defining a rectilinear perimeter for being closely received in said opening of said tray body, said rectilinear perimeter of said object supporting insert including first and second oppositely disposed edges and third and fourth oppositely disposed edges, said third and fourth oppositely disposed edges of said object supporting insert defining lip portions for engaging, and being supported on, said ledge portions of said third and fourth edges of said perimeter of said opening of said tray body; and a locking mechanism for releasably locking said object supporting insert in said opening of said tray body, said locking mechanism including a latch assembly having a bar pivotally mounted on said lower surface of said tray body which selectively engages a keeper mounted on a lower surface of said object supporting insert, whereby said bar extends between said tray body and said object supporting insert as said pivoting bar engages said keeper.

11. The tray of claim 10 wherein said bar defines a hook member and said keeper defines a pin for releasably receiving said hook member.

12. The tray of claim 11 wherein said second edge of said perimeter of said opening of said tray body is provided with a recess defined in said lower surface of said tray body, and wherein said second edge of said perimeter of said object supporting inserts defines a further lip portion for being received in said recess provided in said second edge of said perimeter of said opening of said tray body, whereby upward movement of said second edge of said object supporting insert is prohibited when said object supporting insert is positioned in said opening of said tray body.

13. The tray of claim 12 wherein said locking mechanism includes at least one ball latch mounted in said first edge of said perimeter of said opening of said tray body, said ball latch including a spring biased latch ball, at least a portion of which is removably received in a recess defined in said first edge of said perimeter of said object supporting insert.

14. The tray of claim 10 wherein said tray is provided with a pair of clamp assemblies for releasably engaging a wheel chair, whereby said tray is supported by said wheel chair and the useful object secured to said object supporting insert is disposed for use by an occupant of such wheel chair, said each said clamp assembly including a tray support for being releasably secured to the frame of the wheel chair and including a securing bracket for being mounted on said tray body and for releasably engaging said tray support.

15. The tray of claim 14 wherein each said clamp assembly includes a seat belt-type locking mechanism for releasably securing said securing bracket to said tray support.

16. The tray of claim 15 wherein said tray includes a pair of guide assemblies for supporting said tray body on the wheel chair, each said guide assembly including a guide member for being releasably mounted on the frame of the wheel chair and defining a slot for releasably receiving an edge of said tray body.

17. The tray of claim 16 wherein each said guide assembly includes a base plate on which said guide member is supported, said base plate carrying a downwardly disposed mounting rod, each said guide assembly also including a clamp for releasably engaging the frame of the wheel chair and for releasably engaging said mounting rod at selected positions along said mounting rod to effect the mounting of said guide assembly on the frame of the wheel chair.

18. The tray of claim 10 wherein said tray body is provided with a plurality of leg member for supporting said tray.

19. A tray for removably supporting a useful object, said tray comprising:

a tray body defining an upper work surface and a lower surface, and defining at least one opening;

at least one object supporting insert for being removably received and supported in said opening of said tray body, said object supporting insert defining an upper surface on which the useful object is secured, whereby the useful object is maintained in a stationary position to facilitate its use as said object supporting insert is positioned in said opening of said tray body, and whereby the useful object is removable from said tray body through the removal of said object supporting insert; and a locking mechanism for releasably locking said object supporting insert in said opening of said tray body, said locking mechanism including at least one ball latch mounted in said first edge of said perimeter of said opening of said tray body, said ball latch including a spring biased latch ball, at least a portion of which is removably received in a recess defined in said first edge of said perimeter of said object supporting insert.

20. A tray for removably supporting a useful object, said tray comprising:

a tray body defining an upper work surface and a lower surface, and defining at least one opening therethrough defined by a closed perimeter;

at least one object supporting insert for being removably received and supported in said opening of said tray body, said object supporting insert defining an upper surface on which the useful object is secured, whereby the useful object is maintained in a stationary position to facilitate its use as said object supporting insert is positioned in said opening of said tray body, and whereby the useful object is removable from said tray body through the removal of said object supporting insert;

a locking mechanism for releasably locking said object supporting insert in said opening of said tray body; and a plurality of clamp members for releasably engaging a wheel chair, whereby said tray is supported by said wheel chair and the useful object secured to said object supporting insert is disposed for use by an occupant of such wheel chair.

21. A tray for removably supporting a useful object, said tray comprising:

a tray body defining an upper work surface and a lower surface, and defining at least one opening, said opening of said tray body being defined by a closed rectilinear perimeter including first and second oppositely disposed edges, and third and fourth oppositely disposed edges, each said third and fourth oppositely disposed edge defining a ledge portion, said second edge of said perimeter of said opening being provided with a recess defined in said lower surface of said tray body; and at least one object supporting insert for being removably received and supported in said opening of said tray body, said object supporting insert defining an upper surface on which the useful object is secured, whereby the useful object is maintained in a stationary position to facilitate its use as said object supporting insert is positioned in said opening of said tray body, and whereby the useful object is removable from said tray body through the removal of said object supporting insert, said object supporting insert defining a rectilinear perimeter for being closely received in said opening of said tray body, said rectilinear perimeter of said object supporting insert including first and second oppositely disposed edges and third and fourth oppositely disposed edges, said third and fourth oppositely disposed edges of said object supporting insert defining lip portions for engaging, and being supported on, said ledge portions of said third and fourth edges of said perimeter of said opening of said tray body, said second edge of said perimeter of said object supporting insert defining a further lip portion for being received in said recess provided in said second edge of said perimeter of said opening of said tray body, whereby upward movement of said second edge of said object supporting insert is prohibited when said object supporting insert is positioned in said opening of said tray body.

22. The tray of claim 21 wherein said tray further comprises a locking mechanism for releasably locking said object supporting insert in said opening of said tray body.

23. The tray of claim 22 wherein said locking mechanism includes a latch assembly having a pivoting bar which selectively engages a keeper, whereby said bar extends between said tray body and said object supporting insert as said pivoting bar engages said keeper.

24. The tray of claim 2 wherein said locking mechanism includes at least one ball latch mounted in said first edge of said perimeter of said opening of said tray body, said ball latch including a spring biased latch ball, at least a portion of which is removably received in a recess defined in said first edge of said perimeter of said object supporting insert.

* * * * *